US005546878A

United States Patent [19]

Sakuma

[11] Patent Number: 5,546,878

[45] Date of Patent: Aug. 20, 1996

[54] LOOPER DRIVE MECHANISM FOR SEWING MACHINE

[75] Inventor: Kouichi Sakuma, Yamagata, Japan

[73] Assignee: Suzuki Manufacturing Co., Ltd., Japan

[21] Appl. No.: 281,561

[22] Filed: Jul. 28, 1994

[30] Foreign Application Priority Data

Aug. 10, 1993 [JP] Japan ..... 5-198616

[51] Int. Cl.[6] ..... D05B 57/34

[52] U.S. Cl. ..... 112/162; 112/199; 112/200; 112/220

[58] Field of Search ..... 112/199, 200, 112/197, 162, 166, 159, 220

[56] References Cited

U.S. PATENT DOCUMENTS

| | | | |
|---|---|---|---|
| 2,931,328 | 4/1960 | Pierce | 112/162 |
| 3,450,078 | 6/1969 | Armstead | 112/162 |
| 4,178,864 | 12/1979 | Marcandalli | 112/200 X |
| 4,599,957 | 7/1986 | Marcandalli | 112/199 |
| 5,255,622 | 10/1993 | Baba et al. | 112/162 |
| 5,299,516 | 4/1994 | Sakuma | 112/162 |

FOREIGN PATENT DOCUMENTS

| | | |
|---|---|---|
| 53-131150 | 11/1978 | Japan . |
| 54-36856 | 3/1979 | Japan . |
| 240352 | 9/1990 | Japan . |

*Primary Examiner*—Peter Nerbun
*Attorney, Agent, or Firm*—Lorusso & Loud

[57] ABSTRACT

A looper drive mechanism for a sewing machine includes: two loopers; looper drive shafts for driving the loopers; a main shaft extending across one plane transverse to the looper drive shafts; and torque transmission units for transmitting rotation of the main shaft to the looper drive shafts. The transmission units include: two slant grooved cams fixed to the main shaft and having grooves each extending through a full circumference and slanting relative to the main shaft; U-shaped followers each having two rollers, each of the rollers being supported by the looper drive shaft and rotating about its own axis within the groove of the slant grooved cams; and connection pins for pivotally mounting the U-shaped followers on the looper drive shafts so that the U-shaped followers are not rotatable in a direction in parallel with a line connecting the two rollers with each other but rotatable in a direction perpendicular to the line connecting the two rollers with each other.

6 Claims, 7 Drawing Sheets

LOOPER DRIVE MECHANISM FOR SEWING MACHINE

BACKGROUND OF THE INVENTION

1. Field of the Invention

The present invention relates to a looper drive mechanism for a sewing machine, and more particularly to a looper drive mechanism for transmitting rotation of a main shaft to a looper.

2. Description of the Prior Art

A looper drive mechanism with a grooved cam as shown in FIG. 6 has been conventionally used as a looper drive mechanism for an overlock machine (Japanese Patent Application Laid-Open No. Sho 62-176487). In this looper drive mechanism, a barrel-shaped drum cam 201, provided with grooves 201*a* and 201*b*, is attached to a main shaft 200. When the barrel-shaped drum cam 201 rotates together with the main shaft 200, the rollers 203*a* and 203*b* engage the grooves 201*a* and 201*b*, resulting in oscillation of the looper drive shafts 206 and 207.

However, in the mechanism of this type with the barrel-shaped drum cam 201, since the drum cam 201, the looper drive shafts 206 and 207 and the looper are assembled by attaching to the main shaft 200 during the assembling process, the manufacture process is complicated, time-consuming and laborious. Also, in order to machine the grooves 201*a* and 201*b* in the drum cam 201, it is necessary to design and manufacture a special machine, resulting in increased manufacture cost.

To cope with such problems, a looper drive mechanism with a slant cam and a cam follower has been proposed (Japanese Patent Application Laid-Open No. Hei 5-15681). In this looper mechanism, as shown in FIG. 7, looper drive cams 301 and 302, each of which is a cylindrical slant cam are fixed to a main shaft 300. The looper drive bifurcated cam followers 305 and 306, each in the form of a U-shaped cam follower, are attached to looper drive shafts 303 and 304, and are engaged with the looper drive cams 301 and 302. The looper drive bifurcated cam followers 305 and 306 are mounted on the looper drive shafts 303 and 304 with freedom to cancel the displacement between the main shaft 300 and the looper drive shafts 303 and 304. Accordingly, as the main shaft 300 rotates, the slant angle of the cam surfaces of the looper drive cams 301 and 302 varies in the range of $\pm\theta$ in a plane including the main shaft 300, whereby the looper drive bifurcated cam followers 305 and 306 are angularly moved to rotate the drive shafts 303 and 304.

However, the looper drive cams 301 and 302 and the looper drive bifurcated cam followers 305 and 306 are in line-contact with each other. Accordingly, when the looper drive cams 301 and 302 are angularly moved, the looper drive cams 301 and 302 and the looper drive bifurcated cam followers 305 and 306 generate heat due to frictional resistance. As a result, the durability of the looper drive cams 301 and 302 and the lopper drive bifurcated cam followers 305 and 306 suffers. It is therefore difficult to rotate the main shaft 300 at a high speed. Also, since the frictional resistance adversely affects the components even at a low rotational speed, a large motor having a large output power is required.

SUMMARY OF THE INVENTION

In view of the foregoing difficulties inherent in the conventional looper drive mechanism, an object of the invention is to provide a looper drive mechanism which is less expensive but superior in quality, and which does not require high precision in assembling.

In order to attain this and other objects, according to the present invention, there is provided a looper drive mechanism for a sewing machine, comprising: at least one looper; a looper drive shaft for driving the looper; a main shaft extending across one plane transverse to the looper drive shaft; and transmission means for transmitting rotation of the main shaft to the looper drive shaft. The transmission means includes at least one slant grooved cam fixed to the main shaft and having a groove extending around its full circumference and slanted relative to the main shaft; a U-shaped follower having two rollers each of which is supported by the looper drive shaft for rotation about its own axis within the groove of the slant grooved cam; and a connection pin for pivotally mounting the U-shaped follower on the looper drive shaft so that the U-shaped follower is not rotatable in a direction in parallel with a line connecting the two rollers, but is rotatable within a plane perpendicular to the line connecting the two rollers with each other.

In one embodiment of the looper drive mechanism according to the invention, the transmission means is provided in one looper. In another embodiment of the looper drive mechanism according to the invention, the transmission means is provided in an upper looper and a lower looper. The two slant grooved cams are fixed to the main shaft so that the two slant grooved cams have offset phases in association with the upper and lower loopers. The phases of the two slant grooved cams are offset from each other in the range of 30° to 50°.

Furthermore, the inner diameter of a hole formed in the U-shaped follower, into which the looper drive shaft is inserted, is larger than the outer diameter of the looper drive shaft.

When the slant cam rotates together with the main shaft, the angle of the groove of the slant grooved cam is changed within the plane including the main shaft. Defining the maximum angle between the groove of the slant grooved cam and perpendicular to the main shaft as $\theta$, the slant angle varies within $\pm\theta$ as the main shaft rotates. Accordingly, the U-shaped follower provided with the rollers engaged within the groove is swung within that angle range so that the looper drive shaft which supports the looper is angularly moved and the looper mounted on the looper drive shaft is driven. In this case, the rollers are rotated about their own axes and it is possible to angularly move the U-shaped follow to thereby reduce the frictional resistance in the drive system.

Thus, it is possible to enhance the durability of the sewing machine and to further reduce the drive torque of the sewing machine. Accordingly, a motor having low output power may be used.

Also, since the two slant grooved cams associated with the upper and lower loopers are mounted on the main shaft with their phases offset from each other, the mechanism is suitable for a single-needle, three-thread overlock machine. The phase offset range is preferably 30° to 50° for the normal sewing operation.

Furthermore, the U-shaped follower is not rotatable about the connection pin in a plane parallel with a line connecting the rollers, but is rotatable in a direction perpendicular to the line connecting the rollers. Accordingly, in assembling, it is unnecessary to effect adjustment such that the rotational center of the slant grooved cams is coincident with the looper drive shaft. Thus, the assembling work is simplified. Furthermore, excessive working precision is not needed for the positioning of the hole of the looper drive shaft, and hence the machining of the hole in the looper drive shaft relative to the main shaft may be simplified.

BRIEF DESCRIPTION OF THE DRAWINGS

In the accompanying drawings:

FIG. 4(*b*) is a cross-sectional view taken along the line A—A of FIG. 4(*a*);

DESCRIPTION OF THE PREFERRED EMBODIMENTS

An embodiment will now be described with reference to the accompanying drawings, in which a looper drive mechanism according to the present invention is applied to a single-needle, three-thread overlock machine.

Figure 1:
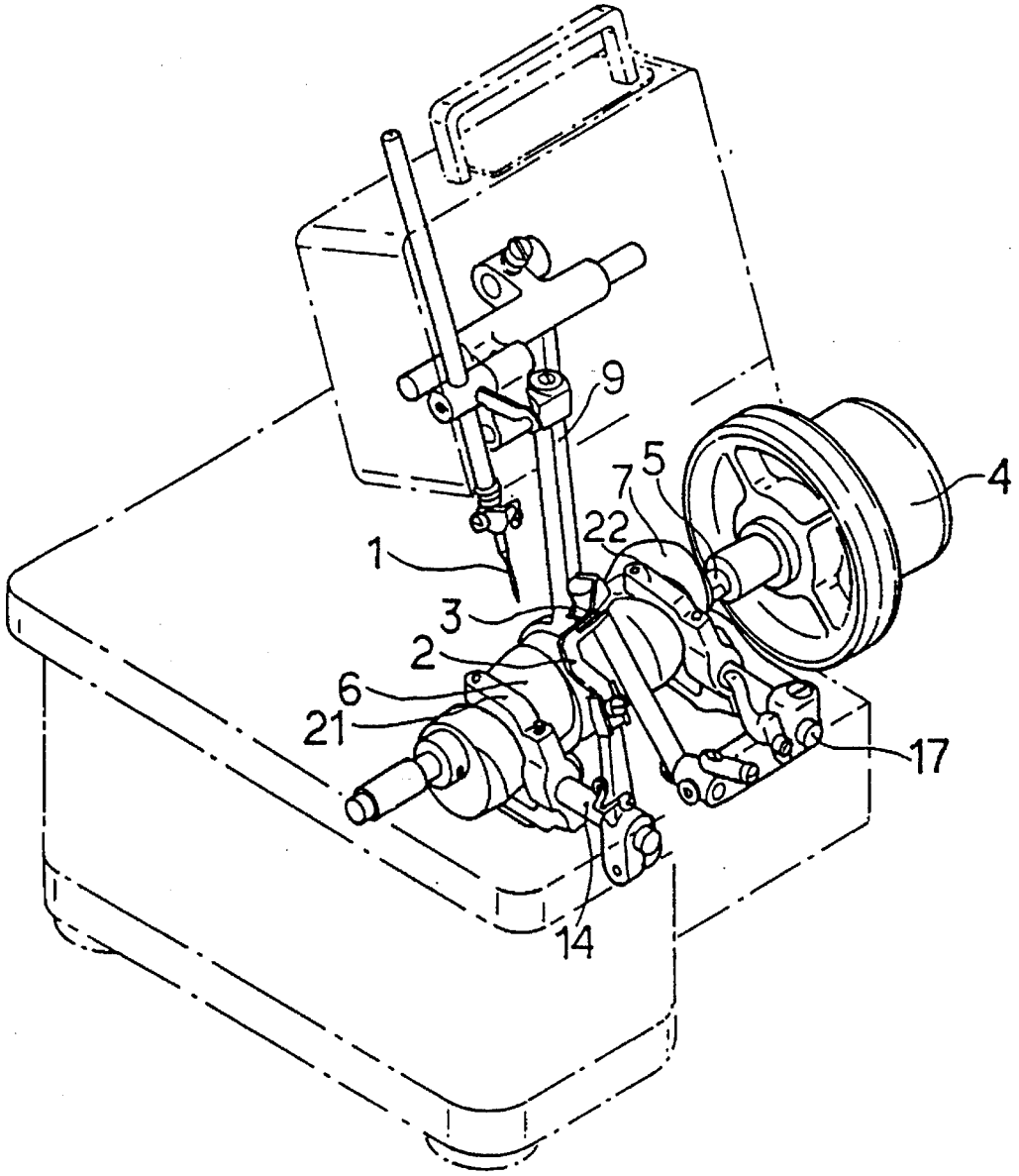
FIG. 1 is a perspective view showing a part of an overlock machine to which a looper drive mechanism according to the present invention is applied.

FIG. 1 shows the overall appearance of the single-needle three-thread overlock machine which is provided with a single needle 1 for substantially vertical linear reciprocating motion. A lower looper 2 travels with an arcuate reciprocating motion across the path of the needle 1, under a needle plate. An upper looper 3 travels with an elliptical reciprocating motion across the path of the needle 1 above the needle plate. Two looper drive cams 6 and 7, which are cylindrical slant grooved cams corresponding respectively to the upper and lower loopers 2 and 3, are attached to a main shaft 5 which rotates coaxially with a pulley 4.

Figure 2:
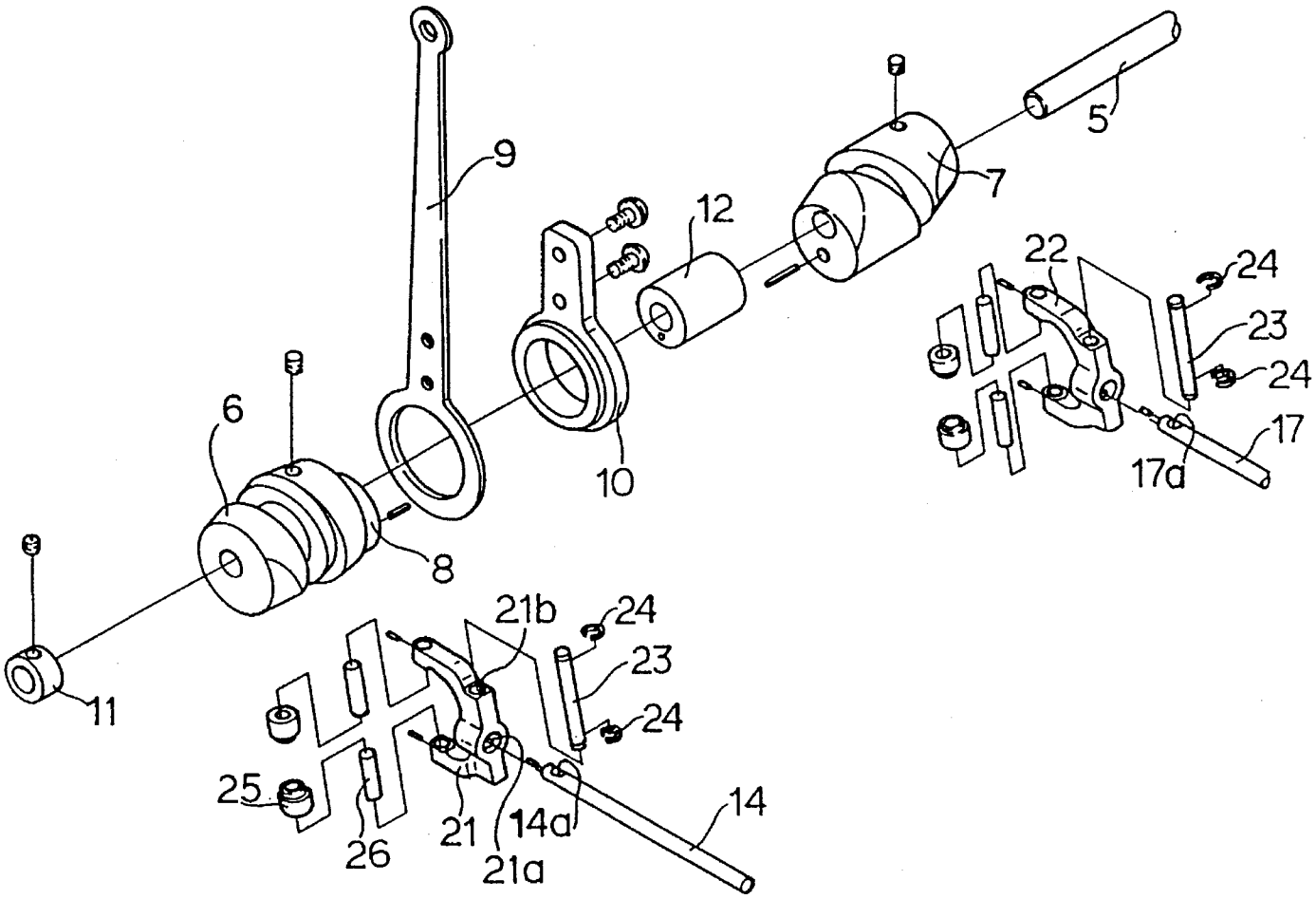
FIG. 2 is an exploded perspective view showing the looper drive mechanism according to one embodiment of the invention.

As shown in FIG. 2, a needle rod eccentric cam 8 is formed on the looper drive cam 6 for driving the needle rod substantially vertically. A needle rod vertical rod 9 is held on the needle rod eccentric cam 8 by a base mount 10. Also, the looper drive cam 6 is fixed to the main shaft 5 by fastening screws, connection pins and a thrust receiver 11. The looper drive cam 7 is likewise fixed to the main shaft 5 by fastening screws and connection pins and is axially positioned through a positioning spacer 12. Thus, the looper drive cams 6 and 7 rotate together with the main shaft 5.

Figure 3:
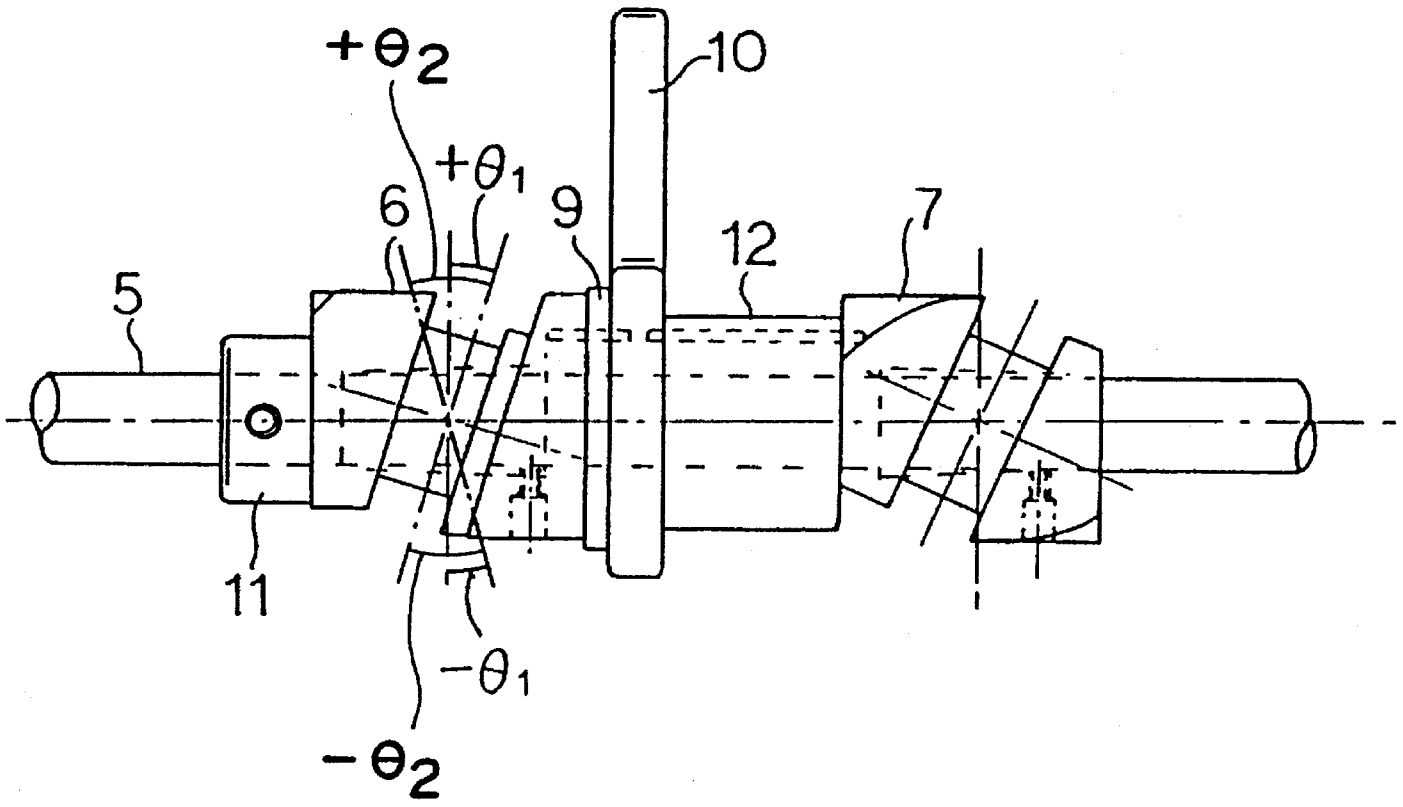
FIG. 3 is a frontal view showing looper drive cams according to one embodiment of the invention.

A groove is formed around the full circumference of each of the looper drive cams 6 and 7 and is slanted relative to the main shaft 5 at angles $\theta_1$ and $\theta_2$ with respect to planes perpendicular to the main shaft 5. Namely, in the single-needle, three-thread overlock machine according to the embodiment, the upper looper 3 is so constructed that it's motion is offset an angle of, for example, about 35° in terms of the rotation of the main shaft 5 relative to the lower looper 2. In correspondence therewith, the looper drive cam 7 is fixed to the main shaft 5 offset at an angle of about 35° relative to the looper drive cam 6. Accordingly, if, as shown in FIG. 3, the angle between the groove of the looper drive cam 6 and a plane perpendicular to the main shaft 5 (i.e., the paper surface of FIG. 3) $\theta_1$ is at maximum. The looper drive cam 7 reaches a maximum angle $\theta_2$ between its groove and a plane perpendicular to the main shaft 5 after the main shaft 5 has rotated through an angle of 35° beyond maximum $\theta_1$.

Incidentally, the grooves of the looper drive cams 6 and 7 may be machined by a general use lathe, thus reducing manufacture cost.

Figure 4A:
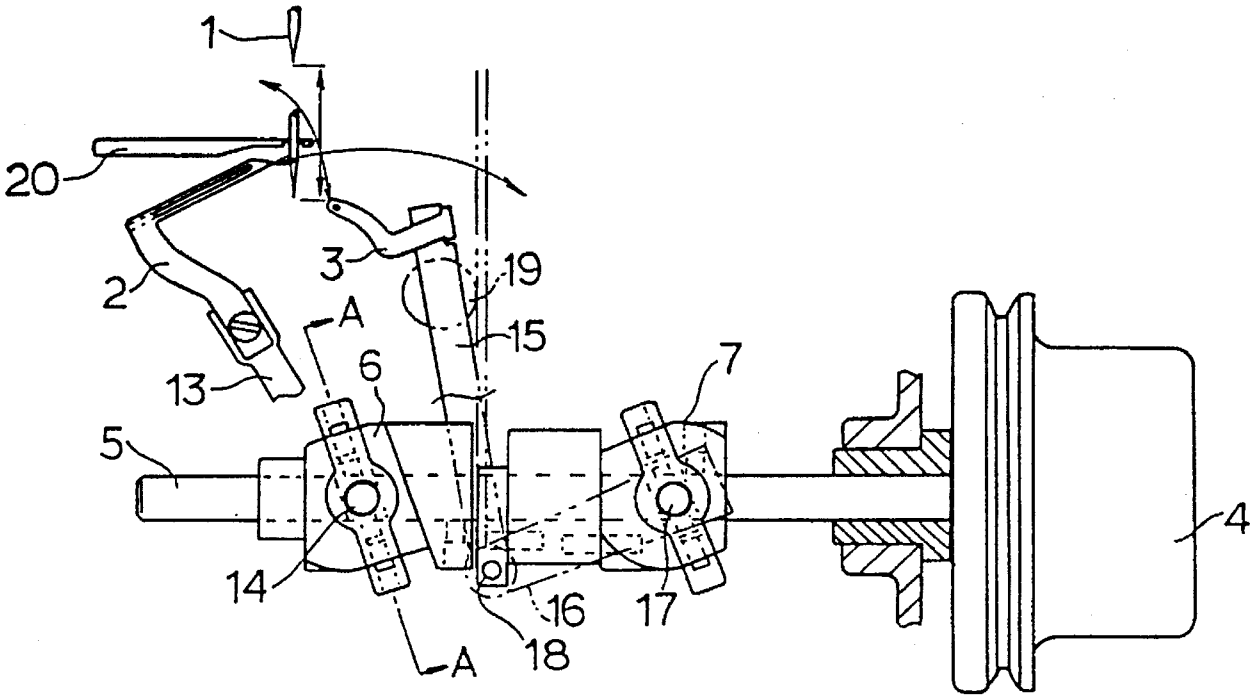
FIG. 4(*a*) is a frontal view showing the looper drive mechanism according to the embodiment of the invention.

As shown in FIGS. 4(*a*) and 5, the lower looper 2 is fixed to a lower looper shaft 14 through a lower looper drive arm 13. As the lower looper drive shaft 14 rotates, the lower looper 2 is driven with an arcuate reciprocating motion within a plane perpendicular to the lower looper drive shaft 14 (i.e., the paper surface of FIG. 4(*a*)). The upper looper 3 is fixed to an upper looper drive shaft 17 through an upper looper drive arm 16. As the upper looper drive shaft 17 rotates, the distal end of the upper looper drive arm 16 is likewise driven with an arcuate reciprocating motion. An upper looper mount shaft 15 is connected to an end of the drive arm 16 through a pin 18 and its motion is restricted by a pivot 19. As the end of the drive arm 16 is driven with an arcuate reciprocating motion, the upper looper 3 mounted on the distal end of the drive shaft 16, in turn, is driven with an elliptical reciprocating motion, reaching top dead center of the needle plate 20 by crossing the needle plate 20 from below. The looper drive shafts 14 and 17 for driving these lower and upper loopers 2 and 3 are supported by the side plate of the machine (not shown) so that axes of the drive shafts 14 and 17 are both perpendicular to the main shaft 5.

Figure 4B:
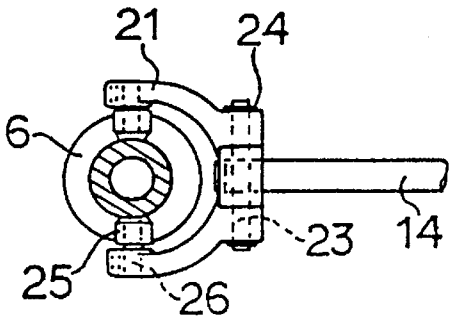

Also, looper drive bifurcated cam followers 21 and 22, which respectively engage the looper drive cams 6 and 7, are mounted on the looper drive shafts 14 and 17, respectively. Since the structure of these bifurcated cam followers 21 and 22 are exactly the same, the following explanation will treat the bifurcated cam follower 21 only. As best seen in FIG. 4*b*, the bifurcated cam follower 21 is a U-shaped member with roller shafts 26 being fixed to the bifurcated ends by fastening screws. Rollers 25 are rotatably mounted on the roller shafts 26. The rollers 25 are engaged within the groove of the looper drive cam 6. The slant angle of the groove varies as the looper drive cam 6 rotates, whereby the rollers 25 swing following the angular movement to rotate the drive shaft 14.

The interconnection between the bifurcated cam follower 21 and the looper drive shaft 14 will now be explained. As shown in FIG. 2, the looper drive shaft 14 is inserted into a central hole 21*a* formed in the bifurcated cam follower 21 with an inner diameter that is somewhat larger than an outer diameter of the looper drive shaft 14. A connection pin 23 is inserted into a hole 14*a* in the looper drive shaft 14 and a hole 21*b* the bifurcated cam follower 21 and is held therein with E-rings 24. A central portion of the connection pin 23 is fastened to the looper drive shaft 14 by a screw. Thus, the bifurcated cam follower 21 is rotatable in a plane perpendicular to a line connecting the rollers 25 but is not rotatable in a plane in parallel to the line connecting the rollers 25. Accordingly, even if the groove of the looper drive cam 6 is not centered relative to the centerline of the looper drive shaft 14 when the rollers 25 are engaged within the groove of the looper drive cam 6, the bifurcated cam follower 21 will nevertheless rotate in a plane perpendicular to the rollers 25 to thereby cancel the displacement from center, so that the looper drive shaft 14 may be positively driven.

Since the transmission means of the looper drive mechanism according to this embodiment is so designed as to cancel any offset between the centerline of the looper drive shaft 14 and the groove of the looper drive cam 6 in the lateral direction, it is possible to smoothly transmit motion from the looper drive cam 6 through the bifurcated cam follower 21 to the looper drive shaft 14.

In order to assemble the looper drive mechanism, the looper drive cam 6 provided with a needle rod eccentric cam 8, the needle rod vertical rod 9, the mount base 10 and the thrust receiver 11 are first fixed to the main shaft 5, and the looper drive cam 7 is then fixed to these components through the positioning spacer 12 to complete the assembly on the main shaft 5. Apart from this assembly, the looper drive shafts 14 and 17 provided with the looper drive bifurcated cam followers 21 and 22 and the pivot 19 are mounted on the machine side plate, the lower looper drive arm 13, to which the lower looper 2 is fastened, is fixed to the looper drive shaft 14, and the upper looper mount shaft 15, to which are fastened are the upper looper 3 and the upper looper mount shaft drive arm 16, is mounted on the looper drive shaft 17 with the pivot 19, to thereby complete the assembly on the machine side plate. After the assembly on the main shaft 5 side and the assembly on the machine side plate side are thus separately completed, the assembly on the machine side plate is mounted on the machine body so that the looper drive bifurcated cam followers 21 and 22 are engaged with the looper drive cams 6 and 7, respectively. Accordingly, the assembly is quite easy and the time needed for assembling is reduced.

The operation of the looper drive mechanism thus constructed will now be explained.

When the looper drive cams 6 and 7 are rotated by the rotation of the main shaft 5, the slants of the grooves of the looper drive cams 6 and 7 are changed in the ranges of $\pm\theta_1$ and $\pm\theta_2$ relative to a plane in which the main shaft 5 lies and which is perpendicular to the looper drive shafts 14 and 17. As a result, the looper drive bifurcated cam followers 21 and 22 provided with the rollers 25 engaged within these grooves are swung and the lower looper drive shaft 14 and the upper looper drive shaft 17 move integrally with the swinging movement through angles in the ranges of $\pm\theta_1$ and $\pm\theta_2$. In this case, even if, with vibration of the main shaft 5, one of the rollers 25 is subjected to a thrust load in, for example, the left direction, the other roller 25 cancels the thrust load by pressing against the grooves of the looper drive cams 6 and 7. Accordingly, thrust due to vibration generation of the main shaft is suppressed to thereby make it possible to always attain stable arcuate reciprocating motion of the loopers 2 and 3. The rotation of the lower looper drive shaft 14 is transmitted to the lower looper 2 through the lower looper drive shaft 13 without any change, and the lower looper 2 is driven in an arcuate reciprocating motion within a plane that is perpendicular to the lower looper drive shaft 14. On the other hand, as the upper looper drive shaft 17 rotates, the end of the upper looper drive arm 16 is driven in an arcuate reciprocating motion to thereby move the upper looper mount shaft 15 connected to the drive arm 16 substantially vertically up and down. The upper looper mount shaft 15 is restricted by the pivot 19 and, at the same time, its movement causes the distal end to move with an elliptical reciprocating motion. Thus, the upper looper 3 has an elliptical reciprocating motion.

Figure 5:
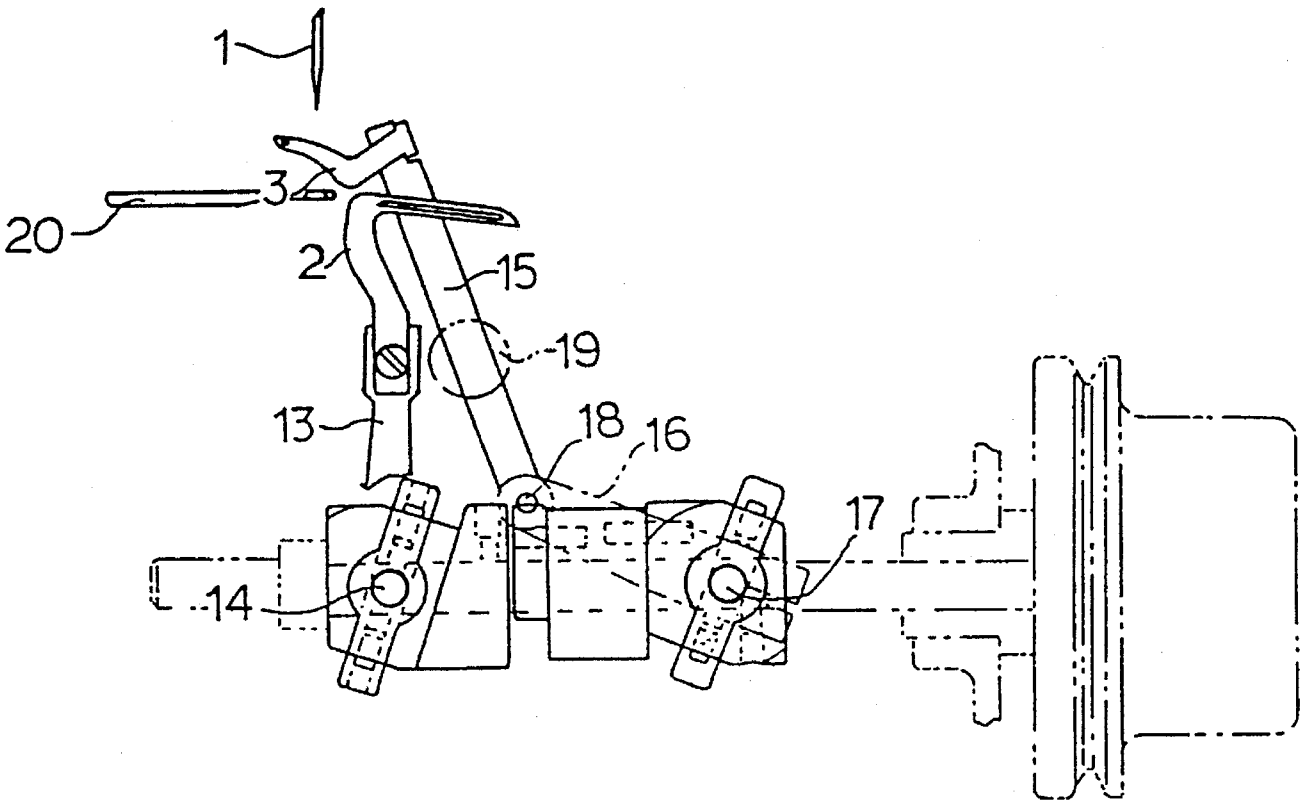
FIG. 5 is a side elevational view showing the looper drive mechanism according to the embodiment of the invention.
Figure 6:
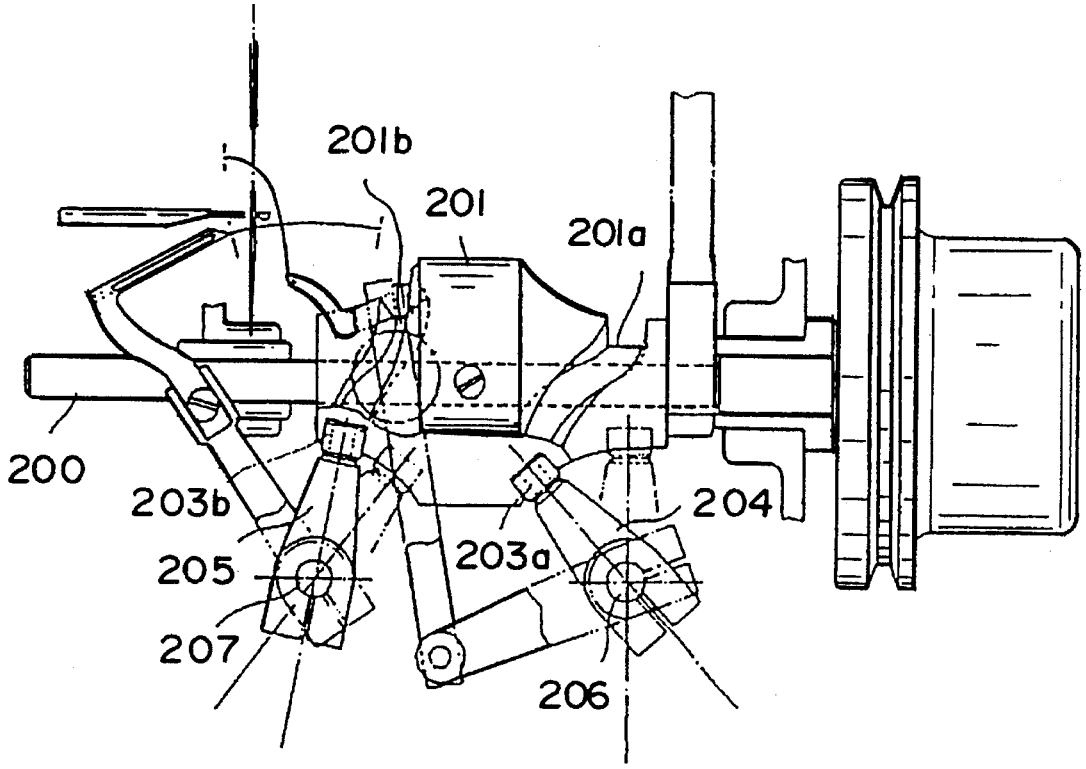
FIG. 6 (PRIOR ART)
FIG. 6 is a front view showing a conventional looper drive mechanism using barrel-shaped drum cams.
Figure 7:
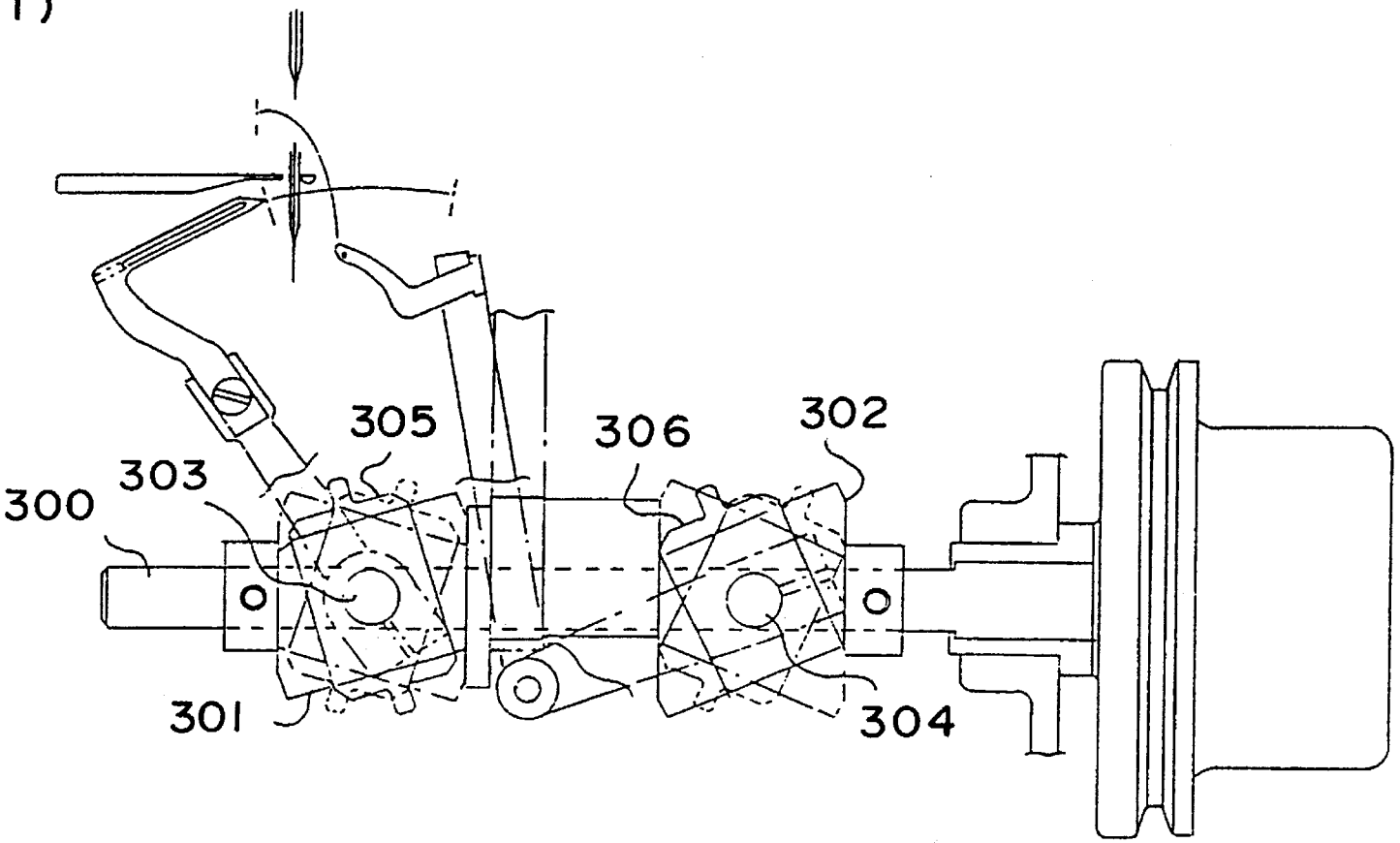
FIG. 7 (PRIOR ART)
FIG. 7 is a front view showing a conventional looper drive mechanism using slant cams.

For instance, assume that a state where the needle 1 is located at the top dead center above the needle plate 20 is 0° of rotation of the main shaft 5 as shown in FIG. 5, and a state where the needle 1 is located at the bottom dead center is 180° of rotation of the main shaft 5 as shown in FIG. 4. When the rotation of the main shaft 5 is 0°, the groove of the looper drive cam 6 is at the maximum slant position of $+\theta_1$, and the lower looper 2 is located at the rightmost end. When the rotational position of the main shaft 5 is at 180°, the groove of the looper drive cam 6 is at the maximum slant position of $-\theta_1$, and the lower looper 2 is located at the left-most end. The phase of the upper looper 3 is offset by about 35°. When the rotational position of the main shaft 5 is at 35°, the groove of the looper drive cam 7 is at the maximum slant position of $+\theta_2$, and at this time, the upper looper 3 is located at the top dead center as shown in FIG. 5. When the rotational position of the main shaft 5 is 180°+35°, the groove of the looper drive cam 7 is at the position of $-\theta_1$, and at this time, the upper looper 3 is located at the bottom dead center as shown in FIG. 4.

Incidentally, in the foregoing embodiment, the upper looper 3 operates with an offset angle of about 35° relative to the lower looper 2. It is apparent that the invention is not limited to this offset angle and it is possible to carry out the sewing operation normally within an offset angle range of 30° to 50°.

Furthermore, in the foregoing embodiment, the needle 1 is moved up and down at a slight slant angle relative to the exact vertical direction and the upper looper 3 is moved within the vertical plane; that is, the upper looper drive shaft 17 is perpendicular to the vertical plane. However, it is possible to apply the invention to the case where the motion plane of the upper looper 3 is out of the vertical plane in relation to the motion of the needle 1. In this case, the upper looper drive shaft 17 is mounted so as to be perpendicular to the motion plane of the upper looper 3.

Also, the foregoing embodiment has been described with reference to a three-thread overlock machine but it is apparent that the looper drive mechanism according to the present invention is not limited to such an overlock machine and may be applied to any other type machine having at least one looper.

As is apparent from the foregoing description, in the looper drive mechanism according to the present invention, the looper drive shaft is driven by the cam followers provided with the rollers engaged with the grooves formed in the cams fixed to the main shaft, whereby the frictional resistance becomes small and the heat generation of the looper drive mechanism may be prevented, resulting in enhancement in durability of the sewing machine. Further, it is possible to reduce the drive torque of the machine so that a motor having a small output power may be used. In addition, the assembling does not require excessively high accuracy. It is therefore possible to provide a looper drive mechanism with high quality and low cost.

Also, in the looper drive mechanism according to the present invention, it is possible to assemble the machine side plate on which the loopers are to be mounted and the machine body on which the main shaft is to be mounted, in separate steps. Accordingly, the assembling work may be extremely simplified and time needed for assembling may be considerably shortened.

Various details of the invention may be changed without departing from its spirit or its scope. Furthermore, the foregoing description of the embodiments according to the present invention is provided for the purpose of illustration only, and not for the purpose of limiting the invention as defined by the appended claims and their equivalents.

What is claimed is:

1. A looper drive mechanism for a sewing machine, comprising:

at least one looper;

a looper drive shaft for driving said looper;

a main shaft extending across one plane transverse to said looper drive shaft; and transmission means for transmitting rotation of said main shaft to said looper drive shaft;

said transmission means including:

at least one slant grooved cam fixed to said main shaft and and having a groove extending around its full circumference and slanted relative to said main shaft;

a U-shaped follower having two rollers, each of which is supported by said looper drive shaft and rotates about its own axis within said groove of said groove slant grooved cam; and a connection pin defining a central, longitudinal axis in parallel with a line connecting said two rollers, said U-shaped follower being mounted on said connection pin for rotation about said longitudinal axis, in a plane perpendicular to said line connecting said two rollers with each other.

2. The looper drive mechanism according to claim 1, wherein said transmission means is provided in one looper.

3. The looper drive mechanism according to claim 1, wherein said transmission means is provided in an upper looper and a lower looper.

4. The looper drive mechanism according to claim 3, wherein two slant grooved cams are fixed to said main shaft so that said two slant grooved cams have offset phases associated with, respectively, said upper looper and said lower looper.

5. The looper drive mechanism according to claim 4, wherein the phases of said two slant grooved cams are offset from each other through an angle in the range of 30° to 50°.

6. The looper drive mechanism according to claim 1, wherein an inner diameter of a hole formed in said U-shaped follower into which said looper drive shaft is inserted is larger than an outer diameter of said looper drive shaft.

* * * * *

UNITED STATES PATENT AND TRADEMARK OFFICE

CERTIFICATE OF CORRECTION

PATENT NO. : 5,546,878

DATED : August 20, 1996

INVENTOR(S) : SAKUMA

It is certified that error appears in the above-indentified patent and that said Letters Patent is hereby corrected as shown below:

Col. 7, line 12, delete "groove". 2nd occurrence

Signed and Sealed this

Eighth Day of July, 1997

Bruce Lehman

*Attest:*

BRUCE LEHMAN

*Attesting Officer*

*Commissioner of Patents and Trademarks*